United States Patent [19]

Ibello, deceased et al.

[11] Patent Number: 4,614,520

[45] Date of Patent: Sep. 30, 1986

[54] LEATHER PROCESSING

[76] Inventors: Alfredo Ibello, deceased, late of Naples, Italy; by Silvio Ibello, heir, Via E. Pomeo 151, 80126 Naples, Italy; by Emma Ibello, heir, 2144 W. Sheridan Rd., San Bernardino, Calif. 92407; by Clelia Ibello, heir, 16761 Viewpoint La., #347, Huntington Beach, Calif. 92647

[21] Appl. No.: 716,572

[22] Filed: Mar. 27, 1985

Related U.S. Application Data

[63] Continuation-in-part of Ser. No. 635,469, Jul. 27, 1984, abandoned, which is a continuation of Ser. No. 543,369, Oct. 19, 1983, abandoned.

[51] Int. Cl.[4] ..... D06P 3/32

[52] U.S. Cl. ..... 8/436; 8/94.14; 8/94.15; 8/94.16; 8/94.17; 8/94.18

[58] Field of Search ..... 8/436, 94.14, 94.15, 8/94.16, 94.17, 94.18; 69/21

[56] References Cited

U.S. PATENT DOCUMENTS

| | | | |
|---|---|---|---|
| 2,229,123 | 1/1941 | Pfannmuller | 8/94.16 |
| 3,006,714 | 10/1961 | Ushakoff | 8/94.18 |
| 3,189,402 | 6/1965 | Sax | 8/94.14 |
| 3,951,593 | 4/1976 | Wojdasiewicz et al. | 8/94.15 |

FOREIGN PATENT DOCUMENTS

| | | | |
|---|---|---|---|
| 0438690 | 1/1975 | U.S.S.R. | 8/94.15 |

OTHER PUBLICATIONS

Rao, et al, *Leather Science,* 14, pp. 65–72 (1967).

Smith, P., *Principles and Processes of Light Leather Manufacture,* Chemical Publishing Co., pp. 238–239, N.Y. (1942).

Davis, C. T., The Manufacture of Leather, Henry Carey & Baird & Co., London (1897) pp. 150–151.

*Primary Examiner*—Paul Lieberman
*Assistant Examiner*—John F. McNally
*Attorney, Agent, or Firm*—Morland C. Fischer

[57] ABSTRACT

A process is disclosed for preparing a suede leather product from animal hides. The hide is scalded before tanning and the finished product can be washed and ironed in a manner similar to a woolen garment. The hide is pretanned in formaldehyde, neutralized in sodium bicarbonate, tanned with a basic chrome solution, neutralized with sodium sulfate, and dyed with a direct color dye. More specifically, an outer suede product is obtained from the external corium of the skin, instead of the flesh side, with the result that less expensive sheepskin acceptable to the trade can be used in place of top grade kidskin and goatskin suedes. In a preferred practice of the method, the hide is burnt twice in scalding steps carried out in a swelling state, soon after first and second fleshing steps and, prior to a bating step. The burning affects the entire thickness of the fibrous grain layer by exposing the upper layer of the corium by soaking the hide in the third solution of sodium sulfide after a third fleshing step. The process obtains a soaped-water washable skin capable of maintaining a soft condition and avoiding fading of the dye. The washable condition is obtained by soaking the dyes, greased with egg yolk, in hot water.

29 Claims, 2 Drawing Figures

LEATHER PROCESSING

CROSS-REFERENCE TO RELATED APPLICATIONS

This is a continuation-in-part of application Ser. No. 635,469, filed July 27, 1984, abandoned, which is a continuation of application Ser. No. 543,369, filed Oct. 19, 1983, abandoned.

FIELD OF THE INVENTION

This invention relates to preparation of suede leather products. A leather product is disclosed which is washable and colorfast along with a process for making the product.

BACKGROUND OF THE INVENTION

Suede products are used in the garment industry for making items of clothing. Finished suede jackets and coats, for example, are fashionable and command a high price in the market.

A major problem affecting suede products is that they are not washable in water. A finished suede product soaked in water generally becomes cracked and brittle upon drying. Moreover, suede products are not colorfast and the dye used to prepare them usually runs out after soaking, which leaves unsightly spots and ruins the garment.

It is therefore necessary to dry clean suede products. Owing to the cost and inconvenience of maintenance, the owner of a suede garment generally is careful not to wear it in the rain or in other inclement weather. This reduces the versatility of the garment. In addition, suede garments are dressy, so it is desirable to wear them for social evenings in places such as nightclubs. The heavy cigarette smoke pervading public places forces the owner to dry clean the garment after most outings.

There is need for a suede garment which is washable and colorfast in ordinary water and which will retain its luster and texture after washing. The need extends to a process for making such a washable suede product.

Another problem affecting the marketing of suede products is the high price of goatskin and kidskin suede. Because of their full grain and smoothness, they command a high price in the market. The process of this invention can obtain from less expensive sheepskin a finished product acceptable to the trade as the equivalent of kidskin, at about half the cost.

SUMMARY OF THE INVENTION

This invention provides a method for tanning an outer suede skin. The finished product can be cared for in a manner similar to a woolen sweater and can be washed in cold water and ironed at a temperature suitable for woolen products. Beginning with the starting material comprising a hide having a flesh side and an epidermis side, one embodiment of the method comprises soaking the leather in cold water for removing impurities and preservatives, applying a paste comprising quicklime, calcium hydrosulfide, and sodium sulfide to the flesh side of the hide essentially without directly contacting the epidermis side of the hide, and removing wool and the paste from the hide to dehair the hide. The hide is soaked in a first solution of sodium sulfide, after which the hide is fleshed with a fleshing machine on the flesh side.

The method continues with scalding the epidermis side of the hide by contacting its surface with a hot roller at a temperature of about 100° C. The preferred scalding step is to contact the surface with a single hot metal roller. The method continues by soaking the hide in a second solution of sodium sulfide; fleshing both sides of the hide with a fleshing machine to remove the flesh from the hide; scalding the epidermis side, as described above, by contacting the surface with the roller only once; soaking the hide in a third solution of sodium sulfide; and fleshing again. The hide is then neutralized by rinsing it in water until all traces of alkalinity have been essentially eliminated.

The hide is then bated with a bating agent, after which the fleshing step can be repeated. The hide is pretanned by tumbling in a pretanning bath containing formaldehyde. Sodium bicarbonate is added to the formaldehyde-containing pretanning bath to fix the hide, and the hide is removed from the bath and allowed to drip essentially without folding.

The hide is tanned by tumbling the hide in a tanning bath containing chromium sulfate in a concentration of up to about 2% of the weight of the hide, after which the hide is allowed to drip again essentially without folding. The hide is neutralized by soaking the hide in a neutralizing bath containing sodium sulfate, followed by drip drying the hide essentially without folding.

The method continues with fulling the hide by dampening the hide and spinning the hide until uniformly damp, shaving the hide on the epidermis side, soaking the hide in a solution containing ammonium sulfate, and degreasing the hide by washing with a soap.

The hide is ammonia treated and them tumbled in a dyeing bath containing a direct color dye at a temperature from about 158° F. to about 176° F. until the dye is absorbed, after which the hide is soaked in a solution containing chromium sulfate and allowed to drip. The hide is buffed to a smooth texture to complete the process. The method continues by greasing the hide with egg yolk, soaking it in hot water, and buffing to a smooth texture to complete the process.

DESCRIPTION OF THE DRAWING

These and other aspects of the invention are best understood by referring to the following detailed description and the accompanying drawing which is a flow diagram illustrating a process for preparing an outer suede product according to principles of this invention.

DETAILED DESCRIPTION

Figure 1:
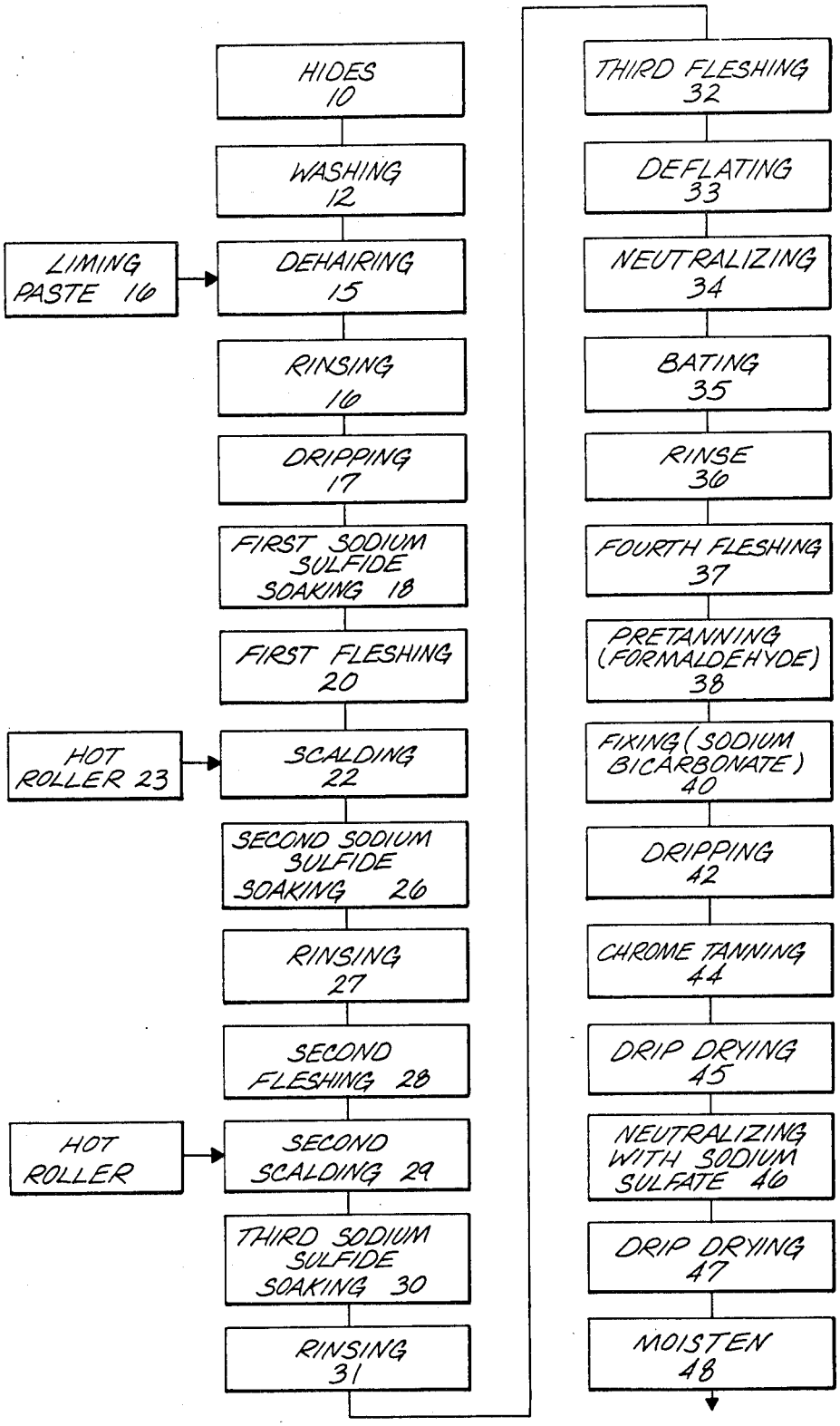
Figure 2:
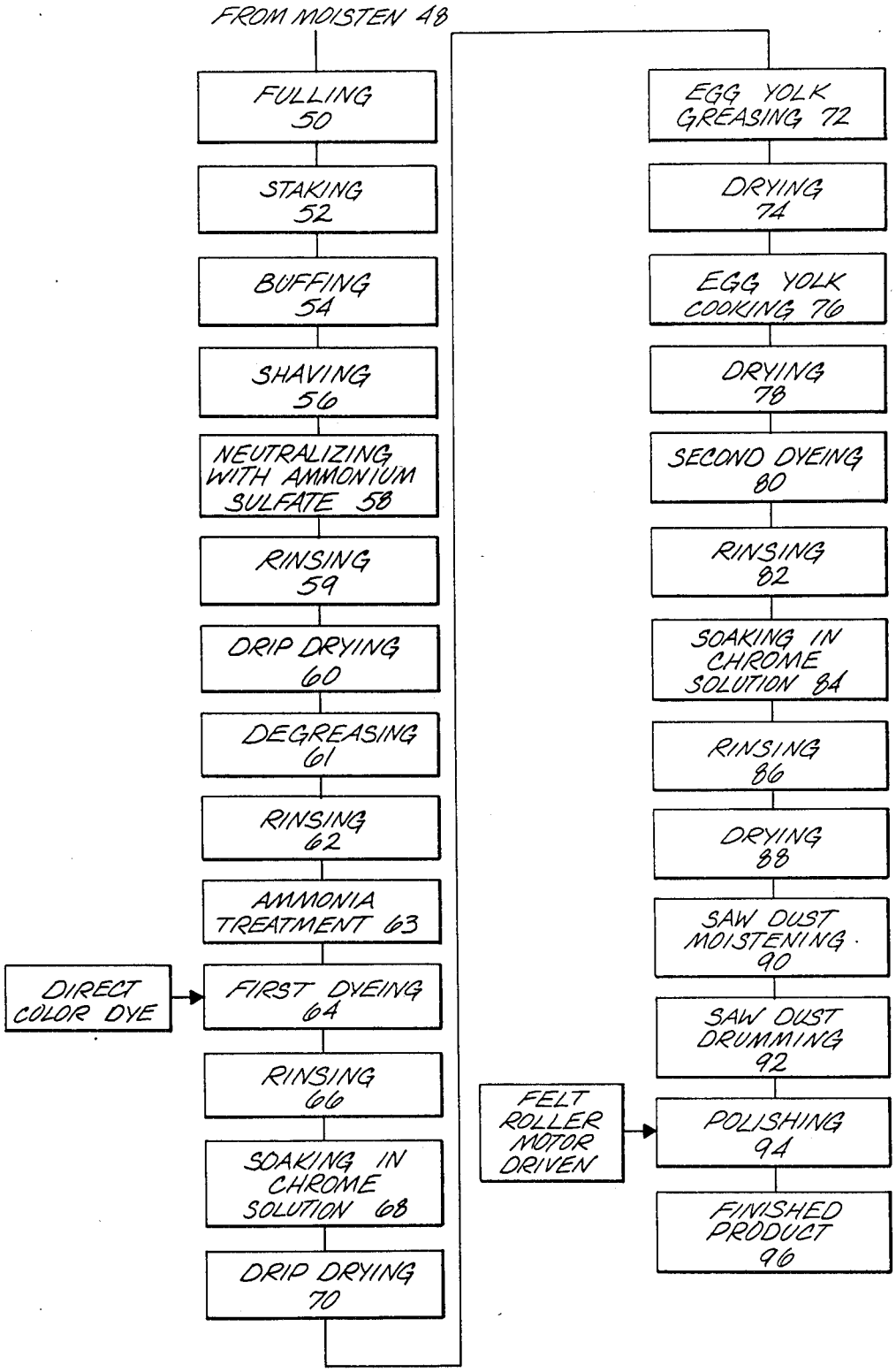

Hides 10 from a slaughterhouse or the like are received and washed at 12 by soaking in cold water for 48 hours in a rotatable drum or in a mill. At the end of 48 hours, the hides are rinsed thoroughly to eliminate any residual blood or other impurities. During later steps in the presently preferred process, the hides will be soaked in a sodium sulfide solution. Any residual blood or foreign matter should be removed during washing or it could later stain the hide.

Hides received from a slaughterhouse usually are stained with blood or other impurities, and have been temporarily preserved with salts and other substances. The preliminary soaking in water eliminates any impurities which may have adhered to the hide or to the flesh, and also eliminates the substances used for preserving the hides. During soaking, the water temperature should be about 50° F. to about 60° F. If the hides are very dirty, the cleansing process can be improved by changing the water after about 12 hours of soaking.

During soaking, the hides absorb a quantity of water almost equal to their dry weight. This causes the hides to inflate and increases the softness of the hides.

Hides received from a slaughterhouse are typically either dried hides, fresh salted hides, or dry salted hides. Dried hides have been left out to dry, often in direct sunlight. Dried hides are rigid because their liquids have evaporated and the albuminoid matter in them has solidified, which binds the skin fibers together as if they were cement. When the drying process has been too violent, for example in direct sunlight, collagens in the hide are affected and resist reabsorption of water. To properly soak dried hides, the skin fibers ideally are given back the water they lost in order to restore the albuminoid matter to the state it was in when the hide was fresh, i.e., when the hide was flayed. The hotter and the brighter it was when the hide was dried, the more difficult it will be to cause it to absorb the necessary quantity of water. However, a 48 hour period of initial immersion in fresh water usually suffices to cleanse and soften most dried hides.

Fresh salted and dry salted hides have to be washed thoroughly to eliminate the salt(s) used in preservation. As salt is a form of antiseptic, the washing must be complete in order that the hide becomes essentially salt free. Any salt which remains could delay the action of the micro-organisms present in the hide which assist in a subsequent dehairing step 15. Since salt has dehydrating properties, the dermis of the hide will not inflate until the water has penetrated thoroughly and eliminated the salt. Hence inflation of the hide can be used to check the progress of salt elimination.

By soaking the hides in a rotatable drum, and by rotating the drum occassionally, the fibers in the hides are loosened, they fill with water and are soon completely soaked. For tough and relatively impenetrable hides, the drum can be rotated intermittently to speed up the washing process. However, the hides should not be soaked in water more than about 48 hours, because there is a risk that the hides will ferment to an undesirable extent with longer periods of immersion.

Animal hides contain an outside layer which is commonly referred to as the "epidermis" side, and an inside layer called the "flesh" side. The outer finished layer of most conventional leather products originates from the flesh side of the hide and is referred to as suede. The process of this invention has the advantage of being flexible, in the sense that the outer layer of the finished product can originate from either side of the hide.

After the washing step 12, the hides are rinsed and dehaired at 15. A flat surface or table is covered with a sheet of plastic and the hide is placed on it with its flesh side uppermost. A liming paste 16 is spread homogeneously with a spatula or other suitable tool over only the flesh surface of the hide. In order to recover the wool from the hide, the paste is not allowed to touch the epidermis side of the hide. The hides are then rolled up with the plastic sheet and covered with a moist canvas and allowed to sit for a day. At the end of one day, the wool or hair should come out easily from the hide when pulled by the fingers. If not, the paste should be left on for sufficient time to loosen the wool. The simplest way to remove the paste and the wool is to dehair the hides with a dehairing machine, and the paste and wool should come off easily.

The presently preferred paste used for dehairing is a compound comprising quicklime, calcium hydrosulfide, and sodium sulfide. In one preferred embodiment of such a paste, 100 grams quicklime is mixed with 150 grams calcium hydrosulfide, in one liter of water. Additional water is added as needed to obtain a paste of creamy consistency. The sulfide present should be limited to a concentration of at most one percent in the paste.

The exposure to the liming paste 16 keeps the leather soft while liquefying the root of the hair follicles so that the hair or wool can be removed easily. In addition, the flesh layer also begins to loosen from the hide.

The element sulfur present in calcium hydrosulfide and sodium sulfide in the paste liquefies collagens situated between fibers in the hide. The sulfide permits the paste chemicals to pass through the dermis layer to reach the follicle bases. Without the presence of sulfide in the paste, the epidermis side of the hide would resist chemical attack during later processing steps.

The paste described is particularly useful because the dehairing step takes only about one day to perform. In previous conventional processes, hides were soaked in vats in caustic lime solutions which helped develop the natural micro-organisms in the hide to loosen the wool. However, these processes generally required a week's time before the wool was removed. As much as five days processing time over such known processes can be gained by using the paste liming 16 as described.

Moreover, in processes where the hide is soaked in a lime solution, the lime solution contacts both sides of the hide and dissolves the wool. In contrast, in a presently preferred process of the present invention, the paste is not permitted to touch the epidermis side of the hides so that the wool can be recovered and sold as a useful product.

The wool can be taken from the hide with a sharp bladed curved knife or with a conventional depilating machine. After removing the wool and the paste, the hides are thoroughly rinsed at 16 in cold water, preferably in a conventional rotatable drum having a screen door on the circumference of the drum on the circumference of the drum. The perforations in the screen allow rinse water to be ejected from the drum, while fresh water is added to the rotating drum through a pipe leading to the center of the drum. In a typical rinsing operation, sufficient water is added continuously to the drum to balance the removal of rinse water. After rinsing, the hide is dripped at 17 by putting it on a stool or other hanger to drip off excess water. After the dripping step, the hide is weighed and the weight is noted as a reference for the following steps.

The hides are soaked at 18 in a sodium sulfide solution to prepare them for fleshing. The sodium sulfide begins to liquefy collagens so that they can be removed during fleshing. Two and one-half liters of water per kilogram of hide are added into a hermetically sealable drum along with a solution of decanted sodium sulfide (previously well dissolved in boiling water) to obtain a concentration of about 1.2 g/cc. The hides are placed in the drum and the drum is turned for two hours, after which the hides are left to soak in the drum for an additional ten to twelve hours, ensuring that they are well immersed in the solution. Before the hides are removed from the drum, the drum is turned several times. Without draining the soaking solution, additional water at room temperature is added to the drum. The drum is rotated for about one minute during which time care is taken not to deflate the hides.

The sodium sulfide used in the soaking step 18 is preferably prepared from cresol and decanted to remove particles from the activated carbon which was used as the cresol carrier. It is important to get a mineral separation of sodium sulfide from the particles of activated carbon or else such particles could stain the leather during later steps.

The hides are now ready for a first fleshing step 20. A conventional fleshing machine can be used for this procedure. Such a machine is well known to those skilled in the art of tanning leather and comprises a pair of closely spaced parallel rollers. One of the rollers has helical blades affixed to its outer surface, while the other roller is a rubber coated right circular cylinder. The clearance between the rollers can be adjusted so that the rollers can be pressed tightly together. The hides are inserted between the rollers and the rollers are pressed together to squeeze the hides. During this "fleshing" step, substances liquefied by the immersion in the solution of sodium sulfide at 18 are removed. The initial fleshing step is carried out on the flesh side only, i.e., only the flesh side contacts the bladed roller, while the epidermis side contacts the rubber coated roller. The flesh is loosened from the hide during this step.

After the first fleshing step, the hide is scalded at 22 by placing it on a table and running a single hot metal roller 23 over its epidermis side. The hot roller preferably comprises a hollow right circular cylindrical roller having gas flame burners. The flame is directed inwardly along the interior longitudinal axis of the roller from one of its end faces. The roller should be prepared by heating to a temperature of about 100° C. for about twenty minutes before using it. The roller is passed quickly three times over the epidermis side of the hide at about 10 cm/sec. No portion of the hide should be permitted to stick to the roller, although the roller contacts the hide surface while passing over it. The table under the roller can be protected from heat by providing a fine coat of asbestos (amianthus) on its upper surface.

As a result of these thermal treatments, the burnt thickness of the fibrous grain layer surface in its swelling state ranges from about 0.5 to about 1.5 mm. In essence, the fibrous grain layer is completely thermally eliminated. The useful finished velvet surface, commonly called "suede", originates from the flesh side of the hide. In the present process, the useful finished smooth texture surface called "outer suede" originates from the upper surface of the corium layer, once the fibrous grain layer has been eliminated.

The scalding operation facilitates removal of the epidermis without affecting the corium layer of the hide, and it permits better penetration of dye into the hide during a subsequent dyeing step at 64.

To prepare the drum for further soaking of the hides at 26, a sodium sulfide solution having a density of about 1.0 g/cc at room temperature in a proportion of about 2½ liters of water per kilogram of hide is placed in the drum. The sodium sulfide in this solution should also be decanted from cresol with the particles of activated carbon removed. The hides are placed in the drum and allowed to soak for about 12 hours after drum rotation during the first minute of soaking. During this time, the drum should be turned from time to time as needed for uniform soaking of the hide.

If the hide at this point is greasy, as for example, for ram or sheep hides, the hides are allowed to sit in the drum for an additional two to three hours and the drum is rotated slowly (at about 8–12 revolutions per minute) for the initial three hours of the soaking. On the other hand, for hides which are not greasy, rotation during the initial minute of soaking is sufficient.

After the hides are soaked, the solution is removed from the drum and the skins are rinsed briefly at 27, for about 30 seconds, with clean room temperature water. A second fleshing step 28 is then performed on the hides, this time on both the flesh and epidermis sides. During the second fleshing step, the fleshing machine rollers are tightened sufficiently to ensure that the flesh is removed essentially completely from the hide. A thorough elimination of flesh makes the hide more uniform in thickness, which best prepares the hide for a later shaving step at 56 performed after the hide has been chrome tanned.

The fleshing mechanically cleanses the inside of the hide in the manner of a laxative. Many collagens in the hide come out with fleshing. The previous scalding step 22, which burned the epidermis, facilitates removal of the fibrous grain layer during the second fleshing.

In a second scalding step 29, the hot roller is passed over the epidermis sides only once. A one gm/cm$^3$ sodium sulfide soaking solution is prepared, as described above, and the sides are soaked in it at 30. The drum is rotated for 20 minutes and the hides are left in the solution for a further 10 to 12 hours without rotating the drum during this time. The hides are then rinsed at 31 for about 15 minutes after adding water. A third fleshing step 32 is then carried out on both the flesh and outer side of the skin. The third fleshing step eliminates as much as possible the shreds of flesh left after flaying. The fleshing step is carried out thoroughly in order to facilitate subsequent processing.

After the third fleshing step 32, the hide is deflated at 33. The hide is placed in the drum having the perforated door and is rinsed with water at room temperature, tumbling for about 30 to 40 minutes. New water is added to the drum at a rate which is sufficient to compensate the draining of old water through the perforated door. During rinsing, the drum is rotated, which helps to deflate the hides. The purpose of deflating the hides is to remove the water and sulfide which previously had inflated the hides. The purpose for soaking the hides in the sodium sulfide solutions at 18, 16 and 30 was to liquefy the collagens so that they would be removed by mechanically purging them from the hide during the fleshing steps. If at the end of about 30 to 40 minutes, the hides are not deflated, the rinsing and tumbling is to continue with fresh water at room temperature until deflation occurs.

The hides are next neutralized at 34 to remove all traces of lime. The hides are placed in a drum having a neutralizing bath of warm water at about 100° F. to 102° F. The drum has a hermetically sealed door. The hides are spun and the pH of the hides is checked. For this purpose, a slit can be cut near the head of a hide and the pH checked by inserting indicator solution, such as phenolphthalein, or checked by acetic acid, or litmus papers, in the slit. If there is any indication of alkalinity, a new neutralizing bath of warm water at about 100° F. to 102° F. is prepared and the wash repeated until all traces of alkalinity have been eliminated from the hides. It is necessary to remove all traces of lime from the hides before proceeding.

After the lime has been eliminated in the neutralizing bath, the hides are ready for a bating step 35 which removes all remaining nonfiber type materials from the hide, such as albuminoids and certain collagens. Any conventional bating or macerating agent, which are well-known to those skilled in the art, can be used in a proportion of about two percent agent per weight of the hides. Such agents typically contain bacteria and enzymes. This is why all traces of lime should have been removed before contacting the hide with the bating agent, because lime can interfere with the activity of bacteria and enzymes.

The hides, preferably still warm from the neutralizing bath, are weighed for reference purposes and warm water at about 102° F. to about 104° F. is placed in a hermetically sealable drum in an abundance of no greater than about three liters of water per kilogram of hide. Sufficient bating agent to make up a solution containing about two percent agent per kilogram of hide is mixed in the water. The hides are added and the drum is rotated for an initial half hour, after which time the hides are allowed to steep in the bating solution for an additional 7 to 8 hours. It is advisable to turn the drum once during the bating time. The bating step 35 is finished when the skin of the hide is sticky to the touch.

The bating is preferably carried out in a temperature range of about 100.4° F. to about 102.2° F. The temperature of the water in the drum before the hides are added, about 102.2° F. to about 104° F., is made slightly higher than the preferred range for bating so that the overall temperature of the solution, when the hides have contacted the solution, will be in the preferred range. The solution temperature should be maintained by gentle heating so that the temperature of the hides in the bating solution is not permitted to drop below about 95° F. The preferred range of temperature encourages the bacteria and enzymes in conventional bating agents to function optimally. At such temperatures, the most favorable conditions for bacterial enzymes to act on elastic skin fibers are typically between a pH of about 7.5 and about 8.5. Such conditions can be readily obtained in solutions containing about two percent concentration of conventional bating agents.

After the hides have soaked in the bating solution, the agent is eliminated from the drum and the hides are briefly rinsed in lukewarm water at 36 in a range of about 80° F. to about 100° F.

At this point the quality of the finished product can be improved if an optional fourth fleshing step 37 is performed on both sides of the hides. Most conventional bating agents contain a sawdust which will be eliminated by such an optional fleshing step. Under the pressure of the fleshing machine rollers, the pores in the hide are forced open and certain substances, which have now been loosened, are eliminated. Such unwanted substances, for example, include insoluble lime, fats partially transformed into calcareous soaps and rendered easily emulsionable, and albuminoid substances which have become soluble as a result of the action of the lining paste 16 and sodium sulfide. In effect, the extra fleshing step 37 causes the hides to undergo a slight mechanical purge.

At the end of the fourth fleshing step 37, the hide consists essentially of fibers. Collagens and albuminoids have been essentially removed at this point.

After bating, the hide is pretanned at 38 in a formaldehyde solution. The purpose of this step is to tan the yellow tissue in the hide and make it nonputrifiable. The pretanning step also breaks white fibers into smaller units which, during a later dyeing step at 64, facilitates complete penetration of the dye.

The hides are pretanned by rinsing in lukewarm water, dripped well and weighed for reference purposes. The dripping should not be carried to a point of complete dryness but the weighing should be made on the basis of a well dripped hide. A drum is filled with warm tepid water, about 95° F. to about 102° F., in a quantity of about three liters water for kilogram of dripped hide. The hides are soaked in water and during rotation of the drum, about five grams formaldehyde at 40° Baumé per kilogram of hide are added through the hollow axis pipe of the hermetically sealed drum. The drum is rotated about 45 minutes.

After the 45 minutes of drum rotation, a solution of sodium biocarbonate at half the total concentration of the formaldehyde is added at 40. Initially sodium bicarbonate on the basis of 2.5 grams bicarbonate per kologram of hides is added to the pretanning solution of formaldehyde in three 15 minute intervals. For instance, in 100 kg of dripped hide, the total dosage of sodium bicarbonate is 250 grams. The first installment of bicarbonate is added about 15 minutes after the last installment of formaldehyde was added. The sodium bicarbonate neutralizes the formaldehyde pretanning agent and fixes its activity.

The drum is rotated at about 7 to 8 r.p.m. while the hide is soaking in the solution containing both formaldehyde and sodium bicarbonate. The drum is rotated for several hours until a point is reached where, when the leather is tested by folding it and squeezing it tightly between the thumb and index finger, it has become whiter and drier. This result demonstrates that swelling water has been forced out of the fibers. At this point, the hides are removed from the drum and placed on a stool without folding. They are left to drip at 42, avoiding complete drying, which takes about one to three days. It is important for the hides to drip without folding. Folds are undesirable because it will be difficult to later remove any folds formed in this step.

The sodium bicarbonate was added to the pretanning solution as a neutralizing agent to limit or fix the activity of formaldehyde. If the tanning action of formaldehyde were allowed to proceed indefinitely, it would eventually weaken certain fibers and result in an inferior product. While it is desired to limit the extent of formaldehyde tanning, it is also desired to avoid chemically affecting those formaldehyde species which have at that point combined with the fibers. A good neutralizing agent is a salt derived from a strong base and a weak acid, for the weaker the acid, the stronger will salt hydrolysis be. Sodium bicarbonate is the preferred neutralizing agent. Even if an excess of sodium bicarbonate is used, it maintains its equilibrium so that neutralization occurs uniformly. Sodium bicarbonate also causes a slight enlargement of fibers which are to be chrome tanned, which additionally assists the tanning process.

After pretanning with formaldehyde and fixing with sodium bicarbonate, the hides are chrome tanned at 44 in a basic chromium solution and neutralized at 46 in a sodium sulfate solution. A drum, which should be provided with flights for tumbling the hides, is filled with warm water, about 77° F. to about 86° F. (25° C. to 30° C.), in an abundance of about four liters of water per kilogram of hide, weighed during the previous reference—weighing step, prior to the pretanning step. The hides are placed in the drum. A "basic chrome" tanning solution is previously well dissolved in warm water and comprises decanted basic chrome in a proportion of two percent to the weight of the hides. The weight referred to is the hide weight which resulted after the bating step, i.e., before the pretanning step with formaldehyde. It is important to provide at least four liters of water per kilogram of leather as it is critical that the chrome tanning step 44 be performed in a relatively low concentration of chrome (at most about 2%) in order to effect a slow process of chrome diffusion into the hide.

The drum is rotated at about 5–8 revolutions per minute and one half of the basic chrome solution is poured slowly into the drum. The chrome solution should be added slowly so that it is absorbed by the rotating water as it is introduced into the drum. It is important to keep the local concentration of chromium low, at no more than about two percent of the weight of the hides, so that slow diffusion of chromium into the hides will occur. If chromium is added too quickly, it can form extensive chromium-fiber complexes with the outer surfaces of the hide which can hinder diffusion of the dye during a later dyeing step at 64. There should be at least four liters of water per kilogram of leather present in the drum. If insufficient water is present, the leather can become sharp, bitter, and rough. It would then be necessary to repeat the tanning step 44 with sufficient water and new but dilute the basic chrome solution.

The basic chrome solution should be added in two installments over a period of about three hours, or more. By maintaining the water temperature at about 25° C. to about 30° C., the fibers open sufficiently to accept the chromium. The hides are allowed to steep in the basic chrome tanning solution until the chrome is absorbed. This can be determined when the solution turns a markedly paler color, indicating complete absorption of chrome.

During the time the hides are steeping in the chrome tanning solution, one should check that the hides do not bind or twist together. If this occurs, it is possible that diffusion of the chromium tanning agent into portions of the hides could be blocked, in which case the hides should be untwisted. To minimize such a problem, the tanning drum can be provided with flights to tumble the hides slowly, which discourages the hides from twisting together and exposes their full surfaces to the tanning solution.

When the chrome has been absorbed into the hides, the hides are removed from the drum and placed on a stool or other surface to allow dripping at 45 while avoiding folding. Any folding during dripping could cause eventual spotting or discoloration of the finished product.

The following day, the hides are weighed and placed in a neutralizing bath at 46 in a drum which contains a sodium sulfate solution in a proportion of about 10 percent, but no more than about 10 percent, sodium sulfate to the weight of the chrome tanned hides. The concentration of the solution is about one-half liter of water per kilogram of hides. The drum is rotated for about 10 to 15 minutes and the hides are removed and permitted to drip-dry at 47 for up to about 24 hours again avoiding folds. After dripping, the hides are allowed to hang vertically until dry, after which time the hides can be stored on the ground for several days.

The hides are soaked in sodium sulfate at 46 to deacidify the hides and enable the chrome tanned hides to be dyed at 64 in a neutral solution. This operation is essential because sodium sulfate, being hydroscopic, enables the hide to absorb water easily through the proteic fibers and inter-fibrillar spaces which have been closed during the drip-drying step 47. Ideally, a hide should be neutralized at 46 at a relatively low pH, at most about 7, to eliminate free acids present in the hides without contaminating the basic chrome species which have bonded to the proteins in the hide. In this regard, an excess of hydroxylic ions during neutralization would be damaging as it would tend to dissociate chromium from the hide and make the chrome tanning process unstable. To avoid possible reactions of this type alkalinity in any neutralizing bath should be kept as low as possible, because if neutralizing anions are permitted to enter the coordinated chrome-fiber complexes they would tend to destabilize the tanning process.

After chrome tanning, the leather contains free and combined acids in various forms. For example, such free acids can be expected to have formed as a result of direct hydrolysis of chromium salts. Such combined acids typically would be those hydrolytically bonded to protein, or found in chrome-cationic complexes. If neutralization is taken too far, for example with a neutralizing bath of more than about 7 pH, neutralization may bring about a change in the chromium species bonded with fibers and result in partial detanning.

It is therefore important not to increase the alkalinity of the chrome bonded to the fibers, which can be prevented by keeping the hydroxylic ion concentration low in the neutralizing bath. This is why sodium sulfate is the preferred neutralizing agent for tanning with chromium sulfate. If the neutralization step 46 is carried out carelessly, it is possible to spot the color when the hide is exposed to dye in a later step. However, such an undesirable result can be avoided by limiting the concentration of sodium sulfate in the neutralizing bath, as an upper limit, to about 10 percent of the weight of the hides.

It is possible to use sodium chloride as the neutralizing agent for chrome tanning because it, like sodium sulfate, is also deacidifying and hydroscopic. However, the use of sodium chloride is not presently preferred because it does not reinforce the tanning action of chrome as well as does sodium sulfate.

A vat is filled with cold or room temperature water, and the hides are immersed in it at 48 one at a time for about two to four seconds per hide. The hides are then placed on a pile on the ground and allowed to sit for 2 to 3 hours, covered with a moist canvas. The hides are somewhat impervious upon immersion. The residual water on the hides soaks in very slowly. After several hours, however, the soaking has proceeded satisfactorily. The hides are then spun in a drum until they are fulled, i.e., made uniformly moist and soft. Just enough water, if necessary, should be added to the drum to only dampen the hide and not wet it. The hides are tumbled preferably for about 30 minutes at about 8–15 r.p.m. The hides are then placed in a pile on the ground, covered with a moist canvas.

If, after fulling the hides, the hides are not sufficiently soft, the hides can be further softened while still moist by staking the hides at 52 on a conventional lapping wheel. Lapping should be performed only on the flesh side of the hide. The lapping blades or flights lodge into the hides and loosen the skin fibers. This stretches the hides and opens up the fibers, softening the hides.

To remove any residual shreds of flesh which might otherwise pinch the chamois on the epidermis side, the hides are buffed at 54 while still moist on the flesh side. A high speed 180 r.p.m. buffing machine, with 200 or higher grade carborundum powder sprinkled on the glued surface of the wheel, produces a velvet smooth short fiber hide.

The leather of most hides does not have a uniform thickness as it is originally thicker on the rump and on the buttocks of the animal than on the flanks. To make the leather uniformly thick, the leather is preferably shaved at 56 while still moist, on the epidermis side only from head to tail with a lapping machine using a very fine grade abrasive. If the hide is not moist, it should be moistened by dampening it and spinning it as described in the fulling step 50. The hide is shaved as necessary to give the leather a uniform thickness. During this operation, a small portion of the chrome complexes on the surface of the hide is removed. However, these complexes are replaced in a later soaking step at 68.

At this point, the hide contains formalin and chromium salts which, if permitted to act on the hides indefinitely, would eventually weaken the leather. To neutralize such salts, the hides are soaked at 58 in a lukewarm solution, about 85° F. to about 95° F., adding through the axis pipe the six percent ammonium sulfate per hide weight. The hides are spun for one-half hour in the solution. To calculate the correct weight of the hides, the drip-dried weight of the hides after the shaving step 56 is used. After soaking the hides in the lukewarm ammonium sulfate solution, the hides are rinsed at 59 and checked with an indicator solution for any remaining acidity. Should such a litmus test still indicate acidity, the hides should be washed thoroughly again in lukewarm water. After rinsing the hides, they are hung vertically and are allowed to drip-dry at 60 for several days.

After drip-drying the hides, they are degreased at 61 by placing them in a drum with lukewarm water, about 85° F. to about 95° F., with about three liters of water per kilogram of hide. Liquid soap, in a concentration of about two to three percent of the hide weight, is added to the water. The hides are rotated for a half an hour or more, after which time the hides are rinsed well in a drum with a screen door. At this point the hides are somewhat lighter than they were just prior to the soaking in the ammonium sulfate solution at 58 since some grease has been removed from the hide. It is possible to measure how much grease is removed by weighing the difference. This difference in weight serves as an upper limit for the weight of the dye to be added to the leather during the subsequent first dyeing step.

The hides should be degreased or it is possible to spot the skin. The weight of the grease removed should later be compensated by the dye. Any detergent which can be used for washing woolens is suitable for degreasing the hides. Suitable detergent products for degreasing the hides are thepol, soflan, soilax or elan, which are commonly used to wash woolens.

The hides are then placed in hot water at 62 (approximately 140° F. to 158° F.) contained in a drum in a proportion of about six liters per kilogram of well drip-dried hide. An ammonia treatment at 63 is then carried out by adding ammonia at 2½ percent of the volume of water or 15 grams of liquid ammonia in six liters of water per kilogram of hide. The hides are rotated in the drum for about one-half hour or more while preparing the dye. Upon completion of the tumbling step, the hides are washed in the first washing step in abundant water, using the perforated door to eliminate all traces of ammonia. The second washing step is used with hot water (140° F. to 158° F.), rotating for two minutes so that the hides become warm. Next the hides are removed and allowed to drip and then placed back in the drum while they are still warm.

At this point the hides are next dyed in a dyeing step 64. A direct color dye is prepared in a proportion of about 2½ percent dye to weight of well drip-dried hide, in four liters of water per kilogram of hide. For example, to prepare a dye bath for a total hide weight of 10 kilograms, one kilogram of dye is added to 20 liters of hot water and simmered for 10 minutes. Half of this solution (10 liters) is diluted in 20 liters of warm water at a temperature of 158° F. to 176° F. to obtain a solution of 30 liters of water and 500 grams of color dye. This solution is poured very slowly into a rotation sealable drum with a funnel through the hollow axis pipe.

The dye used is preferably a direct color dye. Suitable direct color dyes can comprise folloni colors or other acid colors which operate in a neutral bath. Folloni colors are commonly used to dye wools, nylons or animal fibers. The dyeing process 64 is performed under the conditions of hot water and a neutral bath. It is believed that direct color dyes penetrate completely inside the fiber, and, once there, they are prevented from leaving by the chromium-fiber complexes fixed from the tanning steps 44 and 46.

The drum should have flights or pegs and be spun at about 14 r.p.m. so that the hides will intermittently fall from the top of the drum due to the action of gravity and the flights. After about 20 to 30 minutes of rotating the hides in the dyeing solution, the hides are checked to determine whether the dye has been absorbed. The hides are rotated as needed until complete absorption of the dye occurs. To check the extent of absorption, the head of the skin can be cut with a blade and visually examined to insure that the dye has penetrated completely from the flesh side through to the epidermis side. When this happens, the dye water is discarded.

Upon complete absorption of the first half portion of the dye into the hides, the drum is rotated while the other half of the dye solution (10 liters) is added to the drum very slowly, keeping the temperature always in the range between about 158° F. to about 176° F. After another 20 to 30 minutes the hides are checked again for complete absorption of the rest of the dye, and, if necessary, rotation of the hides in the dye is continued until complete absorption occurs. It is necessary to wait until the dye bath is cooler before discarding the dye and rinsing the hides. When this happens, the dye water is discarded and the hides are rinsed at 66 in cold running water.

The best results are obtained when the temperature of the dyeing bath is maintained in the range between about 158° F. to about 176° F. Temperatures above about 178° F. allow the dye to penetrate too quickly into the surface layers of the hide and will hinder deeper diffusion of the dye. Temperatures below about 158° F. cause the dyeing process to slow down considerably. As temperature falls below about 158° F., a point can be reached when the hide will no longer accept the dye.

The drum should be rotated at a sufficient speed, preferably about 14 r.p.m., so that the hides will fall intermittently from the top of the drum and not become bunched and twisted together. The drum should have a diameter of at least 300 centimeters to cause lifting and falling of the hides which helps open up the fibers in the hides to accept the dye. The width of the drum should be less than the diameter of the drum. With the temperature maintained in the hot water range between about 158° F. and about 176° F., the fibers open, the dye responds to the temperature, and the color gets inside the hide.

The previous shaving step 56 which involved the outer surface of the hide, not only produced a leather of uniform thickness, but also improved the absorption of dye inside the fibers of the hide.

In order to establish the saturation point of the dye in the hide, i.e., to determine how much more dye can be added in order to achieve a particular shade, an initial dose of dye is tested. The initial dose is in the proportion of three percent of the weight of the hide, for example, 30 grams dye in four liters of water per kilogram of hide. After processing the sample as described for the first half of the dyeing step, the sample can be dried and the shade checked. If the color is too faint, the operation can be repeated with double the amount of dye, that is, six percent of the weight of the hide, using 60 grams of dye in four liters of water per kilogram of hide.

After dyeing, the hides are soaked once again at 68 in a solution of basic chrome. The hides are placed back in a drum and a new solution of the basic chrome used for the tanning step 44 is prepared. Such a solution has a concentration of basic chrome in about 0.5 percent per kilogram of hide, the referenced weight being the weight prior to the degreasing treatment 62. The drum is rotated and the chrome solution is poured in gradually in three installments at five minute intervals. When the solution pales, indicating that chromium has been absorbed completely into the hides, the hides are removed from the drum and allowed to drip well at 70 completely on a stool.

The prior step of moist shaving 56 after the chrome tanning step 44 removed some chromium complexes and would eventually cause the tanned fibers to fade. The step of soaking at 68 in the basic chrome tanning solution after dyeing replaces the layer of chrome which was removed by the shaving step 56. This additional soaking in a chromium sulfate solution after the dyeing step 64 prevents the running or fading of color from the finished product.

The next day, the hides are weighed and placed in the drum. An egg yolk greasing step 72 is then carried out. Four percent per kilogram of egg yolk is dissolved in tepid water. This mixture is placed in the drum filled with hides and one-half liter of water per kilogram of hide at 77° F. The drum is rotated for 15 minutes and the hides are then hung to dry at 74. When dried, the hides are left in place for a few days. Next, two liters of water per kilogram of hide are placed in a container to soak the hides for about 20 minutes at 76. When completed, the hides are hung to dry at 78 for approximately three to four days.

Greasing smoothens the chamois. Other known tanneries in the world lime hides in pits, but the advantage of this rapid sulfide process is that the hides do not stay in the solution very long, so that the internal part is not affected. After heat removal of the outer stratum and the shaving off of the second stratum of epidermis, the dermis is unharmed and has no horny or resistant substances.

The hides require the egg yolk greasing treatment to obtain the slackening of fibers and a good resistance. The egg yolk treatment is made from an abuminoid substance containing an emulsifying oil which produces a light tan. This fatty matter in its state of emulsion penetrates easily, lubricates the fibers and softens the leather, making it smooth to the touch. It has been observed that the dyed hides, greased with egg yolk, become soaped-water washable and do not loosen the color penetrated inside the conjunctive white fibers through the amorphous areas. This is obtained by coagulating the albuminoid substances contained in the egg yolk which become insoluble with the high temperature.

A second dyeing method 80 consists of the following steps. A dye is prepared with the same amounts that were used for the first dyeing step. The hides are weighed before placing the hides in the drum. The water is heated to approximately 140° F. to 160° F. The water is eliminated without letting the hides cool. The drum is rotated and half the prepared dye is added slowly with a funnel through the tube while the drum is rotating. After 20 to 30 minutes of rotation of the drum, the hides are checked to see whether the dye has been absorbed. If all the dye appears to be absorbed, then the dye may be discarded. The drum is started rotating again, and the other half of the dye is added as before, without putting in any more water. After 20 to 30 minutes of rotation in the drum, the hides are checked to see whether the dye has absorbed. If necessary, the drum is continued turning until all the dye has been absorbed. To ensure that the dye has penetrated from one side of the skin to the other, the head or legs can be cut with a blade. Another indication of the degree of absorption is by comparison of the dye water with the prepared dye. When this step is completed, the rinsing water at 82 is discarded and the hides are placed back into the drum with a small amount of water. A basic chrome solution is prepared for soaking at 84. The chrome solution is in a proportion of two percent per kilogram of hide. The drum is turned again and the chrome solution is added to the drum with a funnel in two installments at five minute intervals. The hides are checked to see whether the chrome has been absorbed. The hides are rinsed at 86 and hung up to dry at 88. As a result of this second dyeing treatment, without subsequent greasing, the color becomes bright, intense and resistant to washing with soap suitable for woolens.

The color combines with the basic color without precipitation. Inasmuch as the skin is permeable, penetration of the dye is facilitated by high speed drumming and waterless dye.

Permeability is due to pretanning with formalin, which splits the fibers and allows in-depth dyeing. Guaranteed washability is only obtained if the dye penetrates deeply.

After drying completely, the hides are moistened, drummed and polished as follows. The hides are placed in slightly damp sawdust overnight at 90. The next morning, the hides are rotated in the drum at 92 for a few minutes. Before these operations, the fibers are momentarily plastered down onto the hide, but the moisture combines with the tractive effect of drumming to raise them easily. Practice is necessary to attain the correct degree of humidity. If the hides are not moist enough, stretching on the felt roller in the subsequent polishing step 94 is laborious. The ideal degree is that which enables the hide to dry with the heat produced by the felt roller on which the hides are to be polished. The best method is to put the necessary amount of sawdust into the drum, then add water to the drum until the humidity is thoroughly distributed. Stop the drum and squeeze a sample of sawdust in the palm of the hand.

When the hand opens, the sawdust should just cling together, without wetting the hand. If insufficient water has been added, put in more wet sawdust. In the opposite case, put in more dry sawdust. When the proper degree of moisture has been reached, lay the hides in pairs, flesh sides together, with the layers of damp sawdust between each pair, forming piles about 18 inches high.

The hides are then left overnight. In the morning, they will be ready for drumming. This moistening operation requires practice and care.

The hides are then polished at 94 preferably on a felt roller to obtain smoothness by placing a piece of felt approximately one-third of an inch thick on a motor-driven roller. Both sides of the hide are polished to produce the finished product 96.

The finished hides 96 can be cared for as one would care for a woolen sweater. The hides can be washed in cold water by hand or in a cold water laundry machine cycle. It is best to dry the leather by allowing it to drip dry over a sweater screen, but one can use a low heat cycle dryer if desired. The leather can be washed in cold water and drip dried without spotting the leather, running the dye, or causing the leather to become cracked or brittle. Thus, it is not necessary to dry clean the finished product.

The finished hides can also be ironed and pressed on the flesh side with an iron at a wool temperature setting. The color can be further intensified by briskly pressing the iron without stopping on any point.

A wide range of colors can be applied to dyes using the process of this invention. The finished leather also has a high tear strength and is washable without running of the dye. These properties are believed due to the complete penetration of the dye through the leather which contrasts with many conventional processes where it is believed that the dye is only coated on the outside surface of the leather, similar to a paint spray process.

Collagen in rawhide is known to be ion-bearing and can act on bases and on acids. In this case, the dyeing system depends exclusively on the isoelectric state of the skin, that is according to the collagen's tendency to absorb and assimilate the ions in the dye. The isoelectric point is at 5.2 pH. At a lower pH, anions are bonded, and at a higher pH cations are bonded. Many wool detergents in commerce contain a percentage of soda or similar alkali. Before using the product, it is therefore advisable to test its akalinity with litmus paper. The blue will be more or less intense according to the percentage of soda contained in the wool detergent used.

A direct dye bath may, according to color and mixing method, be a real solution or a colloidal electrolite solution or a poly-dispersed solution, that is, one made up of aggregates of molecules of various sizes in a state of dynamic equilibrium. However, there are free molecules in the dye bath, in the majority of cases at the same time as aggregates of molecules which have been such during the solution process, or which have formed subsequently.

The free molecules are those which are more liable to penetrate into the fibers, because a fiber is not a homogeneous structure; but may be made up of areas arranged in a structure which may be compared to that of a crystal, and areas in which the molecules are less tightly arranged, or even in complete disorder, the latter being known as amorphous areas.

The amorphous areas are those which most affect the dyeing process. When the dye is in the form of single molecules, it can penetrate into the amorphous areas and spread, helped by thermal agitation, which implies not only the molecules making up the amorphous areas themselves, but also the dyeing molecules. Naturally, in order to penetrate, the molecules must be of such a size as to pass through these areas, otherwise the dye is superficial and is liable to rub off. Dye molecules are not all the same size or the same shape, and some therefore penetrate the amorphous areas more easily than others. Once they have entered the fibers, the dye molecules find a suitable environment and stabilize.

Direct dyes are sulphonic acid sodium salts, which dissociate when dissolved into a cation, the sodium, and an anion, the dye. When the fiber is wetted, it acquires a negative potential. There is, therefore, repulsion between the dyeing anion and the negatively charged fiber, which makes absorption of the dye more difficult. The addition of electrolytes reduces this negative potential. At the beginning of the dyeing process, there is an electric barrier between fiber and dye which is greater than the charge of the dyeing anion. Later, due to the presence of electrolytes, the electrical difficulty is overcome. The next stage is the different behavior patterns of various fibers according to their amorphous area content.

In order to ensure good progress on these fibers by the dyes, accurate temperature control is necessary. An increase in temperature accelerates dyeing, but generally decreases the amount of dye absorbed, so that temperature can have two different aspects which influence dyeing times. High temperature encourages color diffusion, i.e., evening of color at the same time reducing dyeing time. An increase of 50° F. may be taken on the average to double dyeing speed.

All direct dyes have their own point of equilibrium. Once the point is reached, dyeing is carried out by slowly cooling the dye bath, ensuring a deep and uniform dye.

The dyeing drum must act in such a way that the hides are lifted by special pins and then dropped so as to obtain maximum action of the dye on the hides. The drum must revolve at the correct speed for this to occur. If the speed is too high, the hides will be held against the walls by centrifugal force.

A 300 cm. diameter drum should not turn at more than about 14 or 15 revolutions per minute, equal to a peripheral speed of about 13,200 cm. per minute. The peripheral speed is the same for all sizes of drums and enables the number of revolutions for any given drum diameter to be calculated as follows:

Number of Revolutions = (Peripheral Speed/Circumference)

where Circumference = diameter × 3.14.

The number of revolutions, however, is not an inflexible factor. The important point is that the hides should fall as far as the internal diameter of the drum allows. Brisk drumming greatly facilitates absorption of the dye, and it should be emphasized that a suitable diameter drum should be used. Thickness must always be smaller than diameter of the drum in order not to defeat its purpose.

What is claimed is:

1. A method for processing a leather hide comprising a flesh side and an epidermis side, the method comprising:

(1) soaking the leather in cold water for removing impurities and preservatives;
(2) applying a paste comprising quicklime, calcium hydrosulfide, and sodium sulfide to the flesh side of the hide essentially without directly contacting the epidermis side of the hide;
(3) removing wool and the paste from the hide to dehair the hide;
(4) soaking the hide in a first solution of sodium sulfide;
(5) fleshing the hide on the flesh side;
(6) scalding the epidermis side of the hide;
(7) soaking the hide in a second solution of sodium sulfide;
(8) fleshing both sides of the hide to remove the flesh from the hide;
(9) neutralizing the hide by rinsing the hide in water until alkalinity has been substantially eliminated;
(10) bating the hide with a bating agent;
(11) pretanning the hide in a pretanning bath containing formaldehyde;
(12) adding sodium bicarbonate to the formaldehyde containing pretanning bath to fix the hide;
(13) dripping the hide essentially without folding;
(14) tanning the hide in a tanning bath containing a basic chrome solution;
(15) drip drying the hide essentially without folding;
(16) neutralizing the hide by soaking the hide in a deacidifying bath containing sodium sulfate;
(17) drip drying the hide essentially without folding;
(18) fulling the hide until uniformly damp;
(19) shaving the hide on the epidermis side;
(20) deacidifying the hide by soaking the hide in a neutralizing bath containing ammonium sulfate; and
(21) degreasing the hide.

2. The method according to claim 1 including:

dyeing the hide in a dyeing bath containing a direct color dye, until the dye is absorbed;
soaking the hide in a solution containing chromium sulfate; and
dripping the hide.

3. The method according to claim 1 further comprising, after bating the hide and before pretanning the hide, fleshing both sides of the hide.

4. The method according to claim 1 where the wool and paste are removed from the hide after about one day.

5. The method according to claim 1 including soaking the hide in a solution containing ammonia.

6. The method according to claim 1 where the concentration of sodium sulfide in the first solution is about 1.2 g/cc.

7. The method according to claim 1 where the concentration of sodium sulfide in the second solution is about 1.0 g/cc.

8. The method according to claim 1 where, during the scalding step, the surface of the hide is contacted with a hot roller at a temperature of at least about 100° C.

9. The method according to claim 1 where the concentration of formaldehyde in the pretanning bath is from about 5 to about 15 grams formaldehyde per kilogram of hide.

10. The method according to claim 1 where the concentration of sodium bicarbonate added to the pretanning bath is about one half the concentration of the formaldehyde.

11. The method according to claim 1 where the concentration of sodium sulfate in the neutralizing bath is from about five to about ten percent of the weight of the chromed hide.

12. The method according to claim 1 where the tanning bath has a chromium sulfate concentration up to about 2% by weight of the hide.

13. The process according to claim 1 including scalding the epidermis side of the hide a second time after step (8).

14. The process according to claim 13 including soaking the hide in a third solution of sodium sulfide and fleshing both sides of the hide after the second scalding step.

15. A process for tanning hides into leather, such hides comprising a flesh side, an epidermis side, and hair on the epidermis side, where, after the wool is removed from the hide to dehair the hide, the process comprises scalding the epidermis side of the hide, and thereafter subjecting the hide to a tanning agent.

16. The process according to claim 15 wherein the epidermis of the hide is scalded by passing a hot roller over its surface.

17. The process according to claim 16 wherein the roller is at a temperature of at least about 100° C. during scalding.

18. The process according to claim 15 in which the scalding is carried out by burning away the fibrous garain surface of the hide.

19. The process according to claim 18 in which the thickness of the scalded grain layer, in its swollen state, ranges from about 0.5 to about 1.5 mm to obtain a deep denaturization of the grain layer.

20. The process according to claim 15 in which the hide is scalded in two phases before tanning; the first time after a first fleshing, by scalding a wet swollen hide grain surface several times; the second time after a second fleshing by scalding a wet swollen side of the hide grain surface.

21. The process according to claim 15 including subjecting the hide to a dyeing agent after the scalding step.

22. The process according to claim 15 including preparing an outer suede product by the following steps, carried out after the dyeing step:

(a) greasing the hide with an egg yolk emulsion,
(b) drying,
(c) exposing the hide in its dried, greased state to high temperature soaking in water, and
(d) drying.

23. A method for preparing a leather product having as its finished outer surface the epidermis side of an animal hide, the starting material being the animal hide having the epidermis side and a flesh side, the method comprising:

(1) applying a liming paste to the flesh side of the hide essentially without directly contacting the epidermis side of the hide;
(2) removing wool and the paste from the hide to dehair the hide;
(3) soaking the hide in a first solution containing sodium sulfide;
(4) fleshing the hide on the flesh side;
(5) scalding the epidermis side of the hide;

(6) soaking the hide in a second solution containing sodium sulfide;
(7) fleshing both sides of the hide to remove the flesh from the hide;
(8) neutralizing the hide until alkalinity has been substantially eliminated;
(9) pretanning the hide; and
(10) tanning the hide.

24. The method according to claim 23 including:
neutralizing the tanned hide in a neutralizing bath;
soaking the hide in a solution containing ammonium sulfate; and
degreasing the hide.

25. The method according to claim 23 including scalding the epidermis side after fleshing step (7), soaking the hide in a third solution containing sodium sulfide, and fleshing the hide again, prior to neutralizing step (8).

26. The process according to claim 23 in which the thickness of the scalded grain layer, in its swollen state, ranges from about 0.5 to about 1.5 mm to obtain a deep denaturization of the grain layer.

27. The process according to claim 23 in which the hide is scalded in two phases before tanning; the first time after a first fleshing, by scalding a wet swollen hide grain surface several times; the second time after a second fleshing by scalding a wet swollen side of the hide grain surface.

28. The process according to claim 23 including subjecting the hide to a dyeing agent after the scalding step.

29. The process according to claim 23 including preparing an outer suede product by the following steps, carried out after the dyeing step:
(a) greasing the hide with an egg yolk emulsion,
(b) drying,
(c) exposing the hide in its dried, greased state to high temperature soaking in water, and
(d) drying.

* * * * *